United States Patent [19]

Bull

[11] Patent Number: 4,927,146

[45] Date of Patent: May 22, 1990

[54] PLAYING CARD HOLDER

[76] Inventor: Arthur E. Bull, 48 Laurel, Mt. Dora, Fla. 32757

[21] Appl. No.: 270,951

[22] Filed: Nov. 14, 1988

[51] Int. Cl.[5] ..... A63F 1/10

[52] U.S. Cl. ..... 273/150

[58] Field of Search ..... 273/148 A, 150; 40/124, 40/124.2, 124.4

[56] References Cited

U.S. PATENT DOCUMENTS

| | | | |
|---|---|---|---|
| D. 73,272 | 8/1927 | Teneau | 273/150 X |
| D. 286,897 | 11/1986 | Herbert | 273/150 X |
| 1,416,447 | 5/1922 | Castles | 273/150 |
| 1,955,340 | 4/1934 | McPherson | 273/150 |
| 2,729,452 | 1/1956 | Baumann | 273/150 |
| 2,811,363 | 10/1957 | McDaniel | 273/150 |
| 3,210,865 | 10/1965 | Muntz | 273/150 X |
| 3,735,516 | 5/1973 | Wenstrom | 40/124.2 X |
| 3,818,905 | 8/1974 | Lebold | 273/150 X |
| 4,630,824 | 12/1986 | Sweet | 273/150 |
| 4,669,733 | 6/1987 | Sweet | 273/150 |

FOREIGN PATENT DOCUMENTS

| | | | |
|---|---|---|---|
| 78434 | 8/1918 | Switzerland | 273/150 |
| 258330 | 9/1926 | United Kingdom | 273/150 |

*Primary Examiner*—Anton O. Oechsle

*Attorney, Agent, or Firm*—Fay, Sharpe, Beall, Fagan, Minnich & McKee

[57] ABSTRACT

A playing card holder comprises a substantially pentagonal backing plate having fixed thereto a locator block and a transparent view plate. The locator block has first and second stepped edges converging upwardly from the bottom edge of the backing plate. Each of the stepped edges includes a plurality of steps each having a horizontal locator surface. The view plate is parallel to and spaced apart from the backing plate to define a card-holding slot therebetween. The view plate has inclined top and bottom edges parallel to the top edges of the pentagonal backing plate. A plurality of deformable filaments, preferably carpet pile, are afixed to the backing plate and extend across the card-holding slot onto abutment with the view plate. The filaments deflect when a playing card is inserted in the card-holding slot and hold the inserted card against the view plate. A base is provided supporting the card holder in an upright position. The base preferably includes a groove in which the bottom edge of the card holder is inserted. A transfer unit having a rectangular backing plate and view plate also is disclosed. Persons having only one usable hand place as-dealt playing cards in the transfer unit and then rearrange the cards in a desired order in the playing card holder. The locator block of the card holder arranges the cards in a fan-shaped pattern.

19 Claims, 3 Drawing Sheets

PLAYING CARD HOLDER

BACKGROUND OF THE INVENTION

1. Field of the Invention

The present invention relates to a playing card holder. More particularly, the invention relates to a playing card holder that enables a person having the use of only one hand to hold and sort playing cards despite such a handicap.

2. Description of the Related Art

Participation in a card game such as bridge is primarily a mental activity. Card playing is a particularly enjoyable activity among elderly and disabled people because it does not require a high level of physical prowess. The primary physical requirements are the ability to arrange the cards that the player is dealt into a desired order, hold the ordered cards in one hand, and discard or pick up with the other hand.

Unfortunately, the minimal physical requirements of card playing are beyond the capabilities of those who are handicapped by virtue of their lacking a usable hand or arm, including elderly persons who are prone to trembling hands. Such persons would benefit greatly from the mental stimulation and social interaction provided by card playing if they had available to them a device that could hold their cards for them in approximately the same manner that the human hand can hold cards.

Conventional card holders suffer from a number of deficiencies that detract from their usefulness to players having disabled arms or hands. First, many card holders are designed to be hand-held. Furthermore, even those conventional card holders that are not hand-held are difficult to use for a person whose usable hand is prone to trembling. Conventional card holders grip only a small portion of the surface of playing cards so that the frictional force between the playing card and gripping mechanism is critical. If the friction coefficient is too high, the player has difficulty inserting cards into the holder and removing them from the holder. If the frictional grip is too low, an elderly person's trembling hand is likely to knock cards out of the card holder inadvertently when attempting to insert or remove a desired card.

The present invention is intended to provide an improved playing card holder that enables a person having only one usable hand to enjoy card playing The present invention also is intended to provide a playing card holder that holds cards securely, yet enables the player to insert and remove cards without difficulty.

In addition, the present invention is intended to provided a playing card holder that frictionally grips a substantial portion of the surface of the playing card while enabling the player to identify the suit and value of the card.

Additional advantages of the present invention will be set forth in part in the description that follows, and in part will be obvious from that description or can be learned by practice of the invention. The advantages of the invention can be realized and obtained by the apparatus particularly pointed out in the appended claims.

SUMMARY OF THE INVENTION

The present invention overcomes the problems of the prior art card holders by providing a device including a transparent view plate and a resilient material disposed behind the view plate to resiliently hold playing cards in frictional contact with the transparent view plate. The view plate and resilient material grip a substantial portion of the surface area of the cards, and the transparency of the view plate enables the player to see the symbols identifying the suit and value of each card.

To overcome the problems of the prior art card holders, and in accordance with the purpose of the invention, as embodied and broadly described herein, the playing card holder of this invention comprises a backing plate, a transparent view plate fixed to the backing plate in a position substantially parallel to and spaced apart from the backing plate to define a card-holding slot therebetween, and means for urging a playing card inserted in the card-holding slot against the view plate. The urging means preferably includes a plurality of deformable filaments fixed to the backing plate and extending across the card-holding slot. The filaments deflect when a playing card is inserted in the card-holding slot to hold the inserted card against the view plate. The filaments can comprise carpet pile.

The present invention also includes an assembly for sorting playing cards that comprises a transfer unit, a primary holding unit, and a base supporting the transfer unit and primary holding unit in upright positions. The transfer unit includes a substantially rectangular first backing plate, a first view plate fixed to the first backing plate in a position such that the first view plate is substantially parallel to and spaced apart from the first backing plate to define a first card-holding slot therebetween, and means for urging a playing card inserted in the first card-holding slot against the first view plate. The primary holding unit includes a substantially pentagonal second backing plate, a locator block fixed to the second backing plate, a transparent second view plate fixed to the second backing plate in a position such that the second view plate is substantially parallel to and spaced apart from the second backing plate to define a second card-holding slot therebetween, and means for urging a playing card inserted in the second card-holding slot against the second view plate. The second backing plate has a second bottom edge, first and second lateral edges extending upwardly from the bottom edge of the second backing plate, and first and second top edges converging upwardly from the lateral edges. The locator block has first and second stepped edges converging upwardly from the bottom edge of the second backing plate, and each of the stepped edges includes a plurality of steps, each having a horizontal locator surface. The stepped edges of the locator block define a bottom face of the second card-holding slot.

The accompanying drawings, which are incorporated in and which constitute a part of this specification, illustrate at least one embodiment of the invention and, together with the description, explain the principles of the invention.

DESCRIPTION OF THE PREFERRED EMBODIMENTS

Figure 1:
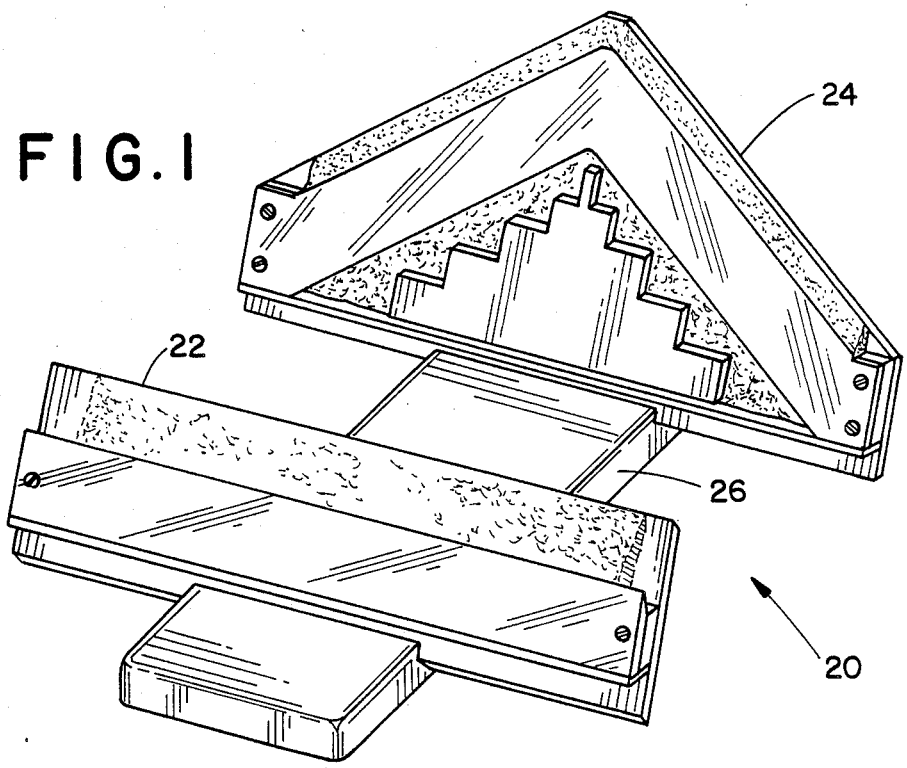
FIG. 1 is a perspective view of the invention showing a transfer unit and primary holding unit supported by a base member.
Figure 2:
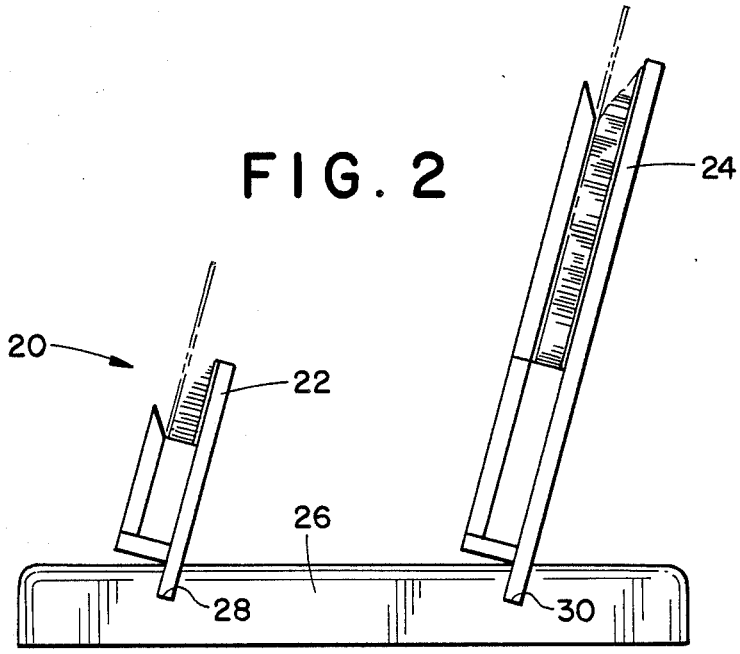
FIG. 2 is a side elevational view of the assembly shown in FIG. 1.

Reference now will be made in detail to the preferred embodiments of the invention, examples of which are illustrated in the accompanying drawings FIGS. 1 and 2 show an assembly 20 for sorting playing cards in accordance with one embodiment of the present invention. Assembly 20 comprises two card holders, transfer unit 22 and primary holding unit 24, and base member 26. Transfer unit 22 and primary holding unit 24 are supported in upright positions by insertion into grooves 28 and 30 formed in base member 26.

Primary holding unit 24 now will be described in detail with reference to FIGS. 3–6.

Figure 3:
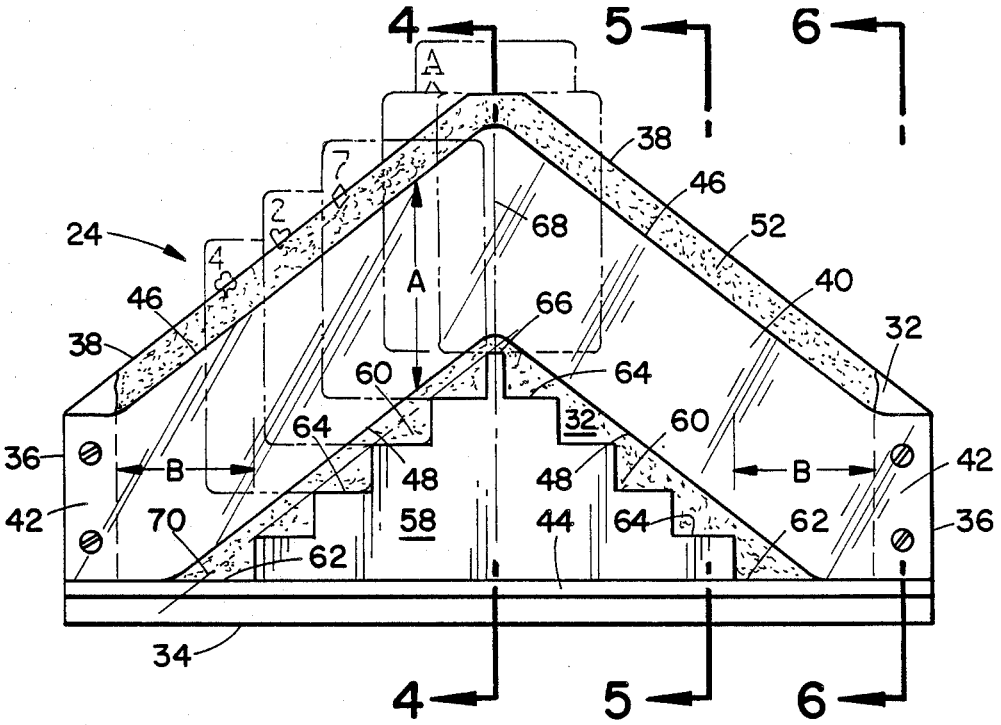
FIG. 3 is a front elevational view of the primary holding unit of the present invention.

In accordance with the invention, primary holding unit 24 includes backing plate 32, which as shown in FIG. 3 preferably has a generally pentagonal shape. In the embodiment shown in FIG. 3, backing plate 32 includes bottom edge 34, lateral edges 36 extending upwardly from bottom edge 34, and top edges 38 converging upwardly from lateral edges 36. It is bottom edge 34 that is inserted into groove 30 of base member 26 in FIGS. 1 and 2. Backing plate 32 preferably is formed of a relatively light-weight, rigid plastic material. Of course, backing plate 32 can be made of other materials such as wood or metal.

The card holder of this invention embodied in primary holding unit 24 also includes transparent view plate 40, which is spaced apart from and preferably parallel to backing plate 32. View plate 40 is fixed to backing plate 32 through spacers 42 positioned adjacent lateral edges 36 of backing plate 32. View plate 40 also is supported by plate support 44, which is fixed to backing plate 32 parallel to and adjacent bottom edge 34. Spacers 42 and view plate support 44 preferably are formed of the same material comprising backing plate 32. View plate 40 preferably is formed of a transparent plastic such as that sold under the trademark Lucite®, a registered trademark of E.I. du Pont de Nemours & Co.

Figure 5:
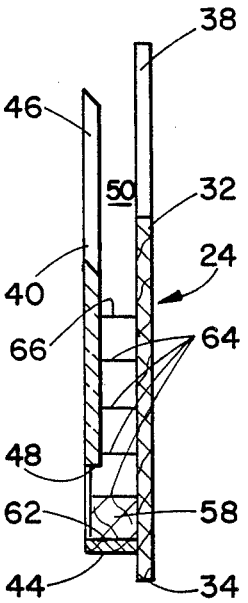
FIG. 5 is a cross-sectional view of the primary holding unit of the present invention taken along line 5—5 of FIG. 3 with the resilient material removed from the card-holding slot.

View plate 40 preferably includes inclined top edges 46, which diverge downwardly from a common point between lateral edges 36 of backing plate 32, as well as lower edges 48. Preferably, top edges 46 and lower edges 48 of view plate 40 are parallel to top edges 38 of backing plate 32. As shown in FIG. 5, backing plate 32 and view plate 40 define a card-holding slot 50 therebetween.

Figure 4:
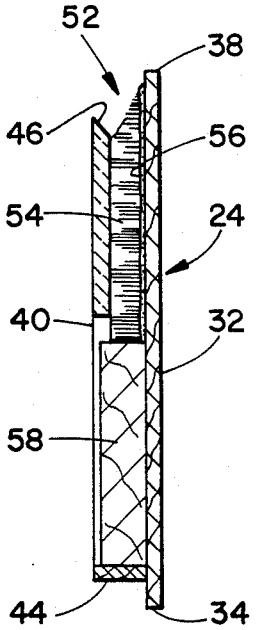
FIG. 4 is a cross-sectional view of the primary holding unit to the present invention taken along line 4—4 of FIG. 3.
Figure 6:
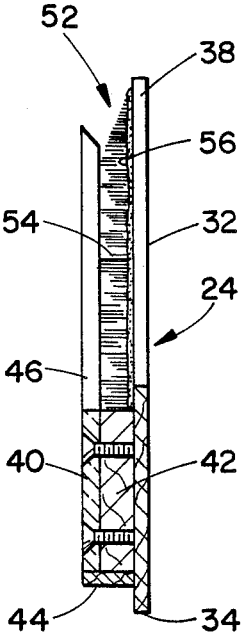
FIG. 6 is a cross-sectional view of a primary holding unit of the present invention taken along lines 6—6 of FIG. 3.

The card holder of this invention includes means for urging a playing card inserted in the card-holding slot against the view plate. As embodied in primary card holder 24 and as shown in FIGS. 4 and 6, the urging means of this invention includes a resilient material 52 fixed to backing plate 32 and extending across card-holding slot 50 into abutment with view plate 40. Resilient material 52 deflects when a playing card is inserted in card-holding slot 50 and holds the inserted card against view plate 40. In the presently preferred embodiment, the resilient material comprises carpet pile, which includes a backing material 56 that is glued to backing plate 32 and a plurality of carpet filaments 54 that extend across card-holding slot 50 into abutment with the inside face of view plate 40.

In accordance with the invention, primary holding unit 24 includes locator block 58, which is supported by view plate support 44 and is fixed to backing plate 32. Locator block 58 includes first and second stepped edges 60 converging upwardly from top surface 62 of view plate support 44. Each stepped edge 60 includes a plurality of steps (four in FIG. 3) each having a horizontal locator surface 64. As shown in FIG. 3, locator block 58 also includes a relatively narrow top locator surface 66 preferably positioned at the lateral centerline 68 of backing plate 32. Backing plate 32, view plate 40, and locator block 58 preferably are laterally symmetric about centerline 68.

Stepped edges 60 of locator block 58 and the portions of top surface 62 on each lateral side of locator block 58 define the bottom face of card-holding slot 50. Playing cards inserted in card-holding slot 50 into abutment with top surface 62 and locator surfaces 64, 66 are arranged in a preselected spatial pattern, preferably a fan-shaped pattern approximating the pattern typical of a hand-held card hand.

Locator block 58 preferably has a thickness greater than the width of card-holding slot 50 to ensure that the bottom edge of a card inserted in card-holding slot does not pass beyond locator surfaces 64, 66. Furthermore, bottom edges 48 of view plate 40 should be disposed in close proximity to stepped edges 60 of locator block 58 to keep cards from bending around stepped edges 60 and passing below locator surfaces 64, 66. As an alternative to the embodiment shown in FIG. 3, the bottom edges of view plate 40 can have a stepped shape to conform with that of stepped edges 60. As an additional alternative, locator block 58 can have a thickness equal to the width of card-holding slot 50, and view plate 40 can have a straight bottom edge conforming with surface 62 of view plate support 44. In this latter configuration, however, a tight fit must be provided between view plate 40 and locator block 58 to prevent cards from slipping into a gap therebetween and becoming difficult to remove from the card holder.

In the preferred embodiment of primary holding unit 24, the vertical dimension A of view plate 40 is approximately three inches and resilient material 52 extends from lower edges 48 of view plate 40 to top edges 38 of backing plate 32. This places a substantial portion of the surface of a playing card (typically having a length of about three and one half inches) inserted in card-holding slot 50 in frictional contact with view plate 40 and resilient material 52. Accordingly, a resilient material imparting a low frictional force per unit area (such as carpet filaments 54) can be relied upon to hold the cards in place, even if the player has trembling hands that are likely to knock around the cards inadvertently, while minimizing the effort required to remove the cards from the card-holding slot. The transparency of view plate 40 aids the player in identifying the suits and values of the cards within card-holding slot 50.

In the embodiment of the card holder of this invention shown in FIG. 3, dimension B between locator block 58 and each spacer 42 should be at least the width of a standard playing card so that a card inserted into card-holding slot 50 will fit into the space between locator block 58 and spacer 42 and rest on surface 62 of view plate support 44. In the embodiment shown in FIG. 3, locator block 58 includes eight steps each having a horizontal locator surface 64, thus providing locations for eight additional playing cards. Two additional playing cards can be supported within card-holding slot 50 on locator surface 66. An additional card, the thirteenth card of a bridge hand, can be held between view plate 40 and resilient material 52 in a "free-floating" position as shown by the ace of spades in FIG. 3.

Stepped edge 60 preferably has risers of approximately ⅝ inch and horizontal locator surfaces 64 of approximately 13/16 inch. Top edges 38 of backing plate 32 preferably are parallel to an imaginary line 70 that is tangent with stepped edge 60 and preferably is spaced from stepped edge 60 so that a standard playing card having one corner supported by a locator surface 64 will have its opposite corner extending approximately ½ inch above top edge 38.

As shown in FIGS. 4–6, top edges 46 of view plate 40 preferably are beveled downwardly toward backing plate 32. In addition, the filaments of resilient material 52 located above top edges 46 preferably have lengths less than the width of card-holding slot 50 and vary from a maximum length adjacent top edges 46 to a minimum length adjacent top edges 38 of backing plate 32. Tapering top edges 46 and resilient material 52 in this manner facilitates insertion of playing cards into card-holding slot 50.

Figure 7:
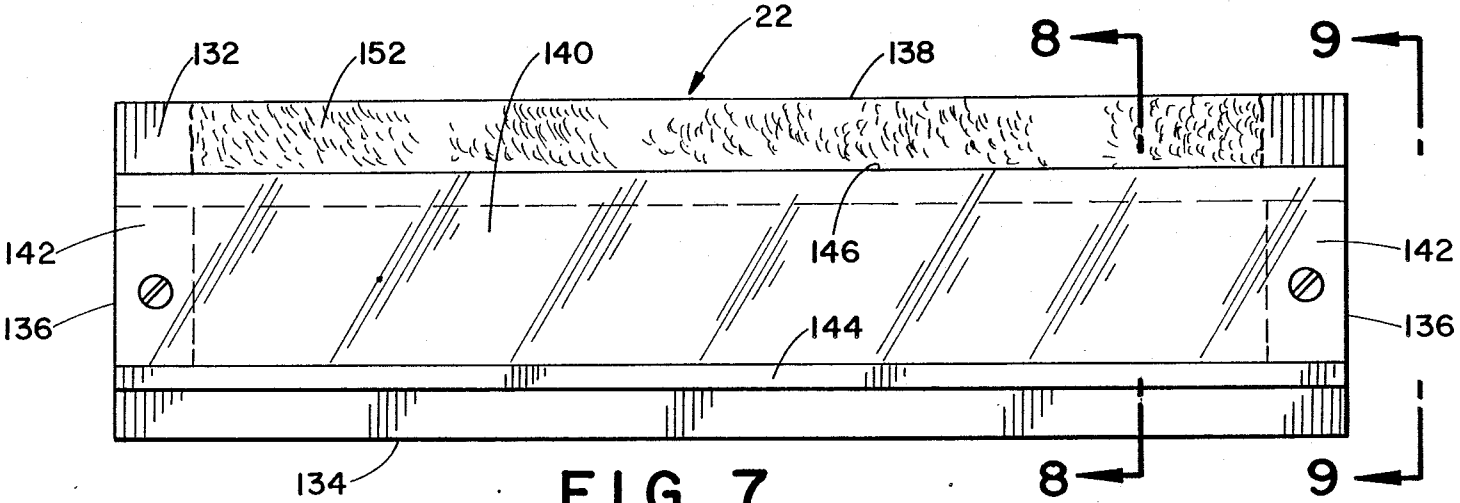
FIG. 7 is a front elevational view of the transfer unit of the present invention.
Figure 9:
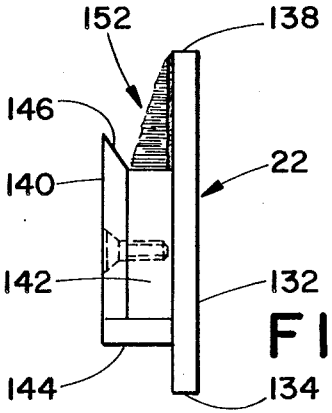
FIG. 9 is a side elevational view of the transfer unit of the present invention taken along line 9—9 of FIG. 7.
Figure 8:
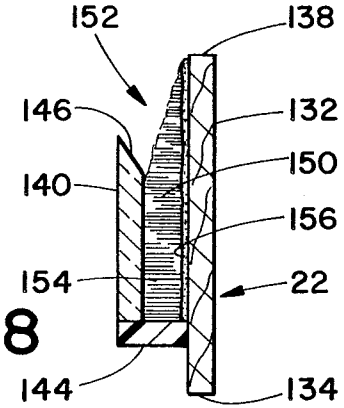
FIG. 8 is a cross-sectional view of the transfer unit of the present invention taken along line 8—8 of FIG. 7.

Transfer unit 22 now will be described in detail with reference to FIGS. 7–9.

In accordance with the invention, transfer unit 22 includes rectangular backing plate 132 having bottom edge 134, lateral edges 136, and top edge 138. Bottom edge 134 is insertable in groove 28 of base member 26 in FIGS. 1 and 2. Transparent view plate 140 is fixed to backing plate 132 through spacers 142 disposed adjacent lateral edges 136. View plate 140 is supported by view plate support 144, which is fixed to backing plate 132. View plate 140 is parallel to and spaced apart from backing plate 132 and defines therebetween a card-holding slot 150.

The transfer unit of this invention includes means for urging a playing card inserted in card-holding slot 150 against view plate 140. As embodied herein, the second urging means of this invention includes a resilient material 152 fixed to backing plate 132 and extending across card-holding slot 150 into abutment with the plate 140. Resilient material 152 preferably is the same material as resilient material 52 and comprises carpet pile including a backing material 156 that is glued to backing plate 132 and a plurality of carpet filaments 154 that extend across card-holding slot 150 into abutment with the inside face of view plate 140. Top edge 146 of view plate 140 and the filaments of resilient material 152 above top edge 146 preferably are beveled as shown in FIGS. 8 and 9 to facilitate the insertion of a playing card into card-holding slot 150.

When using assembly 20 during a card game (see FIGS. 1 and 2), a player normally will place the cards as dealt into transfer unit 22 and then will arrange the cards in the desired order in primary holding unit 24. Alternatively, the player can use a single card holder, primary holding unit 24, and either hold the cards as a mixed suite or rearrange the cards in the desired order within primary holding unit 24. As both transfer unit 22 and primary holding unit 24 are supported in an upright position by base member 26, the player need have use of only one hand to sort, pick up, and discard playing cards.

The card holder of the present invention, as embodied in transfer unit 22 and primary holding unit 24, provides substantial advantages over prior art card holders by exerting low-pressure frictional contact over a substantial portion of the area of the playing card. By putting a substantial portion of the playing card into frictional contact with view plate 40 or 140 and by making the view plate transparent, a reliable card holder can be provided. Even if the player's hand is prone to trembling, it is unlikely that the card inadvertently will be knocked out of the card-holding slot because so much of the card is being gripped between the view plate and resilient material filaments. By the same token, using a resilient material such as carpet pile to hold the playing cards enables the player to remove and insert cards with minimal effort.

It will be apparent to those skilled in the art that other modifications and variations can be made in the card holder of this invention. For example, the primary holding unit can have a locator block that has a different member of steps or that arranges the cards in a different pattern from that disclosed herein. The invention in its broader aspects is, therefore, not limited to the specific details and illustrated examples shown and described. Accordingly, it is intended that the present invention cover such modifications and variations provided that they fall within the scope of the appended claims and their equivalents.

What is claimed is:

1. A holder for playing cards, comprising:

a backing plate;

a transparent view plate fixed to said backing plate, said view plate being substantially parallel to and spaced apart from said backing plate to define a card-holding slot therebetween; and means for urging a playing card inserted in said card-holding slot against said view plate, said urging means including a plurality of deformable carpet pile filaments fixed to said backing plate and extending across said card-holding slot into abutment with said view plate, said filaments deflecting when a playing card is inserted in said card-holding slot and holding the inserted card against said view plate.

2. The holder of claim 1, further comprising a pair of spacers disposed between said backing plate and said view plate.

3. The holder of claim 1, further comprising a base supporting said backing plate in an upright position.

4. The holder of claim 3, wherein said base includes a groove, and said bottom edge of said backing plate is insertable within said groove.

5. The holder of claim 1, further comprising a locator block fixed to said backing plate and defining a bottom face of said card-holding slot, said locator block including a plurality of steps for positioning playing cards within said card-holding slot, whereby playing cards abutting against said steps are arranged within said card-holding slot in a preselected spatial pattern.

6. A holder for playing cards, comprising:

a backing plate having a bottom edge and having first and second lateral edges extending upwardly from said bottom edge;

a locator block fixed to said backing plate and having first and second stepped edges converging upwardly from said bottom edge of said backing plate, each of said stepped edges including a plurality of steps each having a horizontal locator surface;

a transparent view plate fixed to said backing plate, said view plate being substantially parallel to and spaced apart from said backing plate to define a card-holding slot therebetween, said stepped edges of said locator block defining a bottom face of said card-holding slot; and a means for urging a playing card inserted in said card-holding slot against said view plate.

7. The holder of claim 6, wherein said urging means includes a resilient material fixed to said backing plate and extending across said card-holding slot into abutment with said view plate, said resilient material deflecting when a playing card is inserted in said card-holding slot and holding the inserted card against said view plate.

8. The holder of claim 7, wherein said resilient material includes a plurality of deformable filaments fixed to said backing plate and extending across said card-holding slot.

9. The holder of claim 8, wherein said filaments comprise carpet pile.

10. The holder of claim 6, wherein said view plate has first and second inclined top edges diverging downwardly from a common point positioned between said lateral edges of said backing plate, said top edges of said view plate being located such that a playing card positioned in said card-holding slot in abutment with one of said locator steps has at least one corner extending above said respective top edge of said view plate.

11. The holder of claim 6, further comprising a base supporting said backing plate in an upright position.

12. The holder of claim 11, wherein said base includes a groove, and said bottom edge of said backing plate is insertable within said groove.

13. A holder for playing cards, comprising:

a substantially pentagonal backing plate having a bottom edge, first and second lateral edges extending upwardly from said bottom edge, and first and second top edges converging upwardly from said lateral edges;

a locator block fixed to said backing plate and having first and second stepped edges converging upwardly from said bottom edge of said backing plate, each of said stepped edges including a plurality of steps each having a horizontal locator surface;

a transparent view plate fixed to said backing plate, said view plate being parallel to and spaced apart from said backing plate to define a card-holding slot therebetween, said stepped edges of said locator block defining a bottom face of said card-holding slot, said view plate having first and second inclined top edges diverging downwardly from a common point positioned between said lateral edges of said backing plate, said top edges of said view plate being located such that a playing card positioned in said card-holding slot in abutment with one of said locator steps has at least one corner extending above said respective top edge of said view plate; and a plurality of deformable filaments fixed to said backing plate and extending across said card-holding slot into abutment with said view plate, said filaments deflecting when a playing card is inserted in said card-holding slot and holding the inserted card against said view plate.

14. The holder of claim 13, wherein said top edges of said view plate include a beveled edge surface inclined downwardly toward said backing plate.

15. The holder of claim 13, wherein said filaments include:

first filaments fixed to said backing plate below said top edge of said view plate, said first filaments having lengths greater than or equal to the width of the space between said view plate and backing plate and being in abutment with said view plate; and second filaments fixed to said backing plate above said top edge of said view plate, said second filaments having lengths less than the width of the space between said view plate and said backing plate, the lengths of said second filaments decreasing from a maximum length adjacent said top edges of said view plate to a minimum length adjacent said top edges of said backing plate.

16. The holder of claim 13, wherein said first and second top edges of said view plate are substantially parallel to said first and second top edges of said backing plate, respectively.

17. The holder of claim 13, wherein:

said backing includes a vertical centerline equidistant between said lateral edges; and each of said backing plate, said view plate, and said locator block is laterally symmetrical about said vertical centerline.

18. An assembly for sorting playing cards, comprising:

a. a transfer unit including:

a substantially rectangular first backing plate having a bottom edge;

a transparent first view plate fixed to said first backing plate, said first view plate being substantially parallel to and spaced apart from said first backing plate to define first card-holding slot therebetween, and means for urging a playing card inserted in said first card-holding slot against said first view plate;

b. a primary holding unit including:

a substantially pentagonal second backing plate having a bottom edge, first and second lateral edges extending upwardly from said second bottom edge of said second backing plate, and first and second top edges converging upwardly from said lateral edges, a locator block fixed to said second backing plate and having first and second stepped edges converging upwardly from said bottom edge of said second backing plate, each of said stepped edges including a plurality of steps each having a horizontal locator surface, a transparent second view plate fixed to said second backing plate, said second view plate being substantially parallel to and spaced apart from said second backing plate to define a second card-holding slot therebetween, said stepped edges of said locator block defining a bottom face of said second card-holding slot, and means for urging a playing card inserted in said second card-holding slot against said second view plate; and c. a base supporting said transfer unit and said primary holding unit in upright positions.

19. The assembly of claim 18, wherein said base includes a pair of grooves, said bottom edge of said first backing plate is insertable in one of said grooves, and said second edge of said second backing plate is inserted in the other of said grooves.

* * * * *